United States Patent [19]

Dennis

[11] Patent Number: 4,592,433

[45] Date of Patent: Jun. 3, 1986

[54] CUTTING BLANK WITH DIAMOND STRIPS IN GROOVES

[75] Inventor: Mahlon D. Dennis, Kingwood, Tex.

[73] Assignee: Strata Bit Corporation, Houston, Tex.

[21] Appl. No.: 657,535

[22] Filed: Oct. 4, 1984

[51] Int. Cl.[4] ..... E21B 10/46

[52] U.S. Cl. ..... 175/329; 175/410

[58] Field of Search ..... 175/329, 410, 409, 374, 175/330, 408, 413; 51/309, 307, 293, 297; 408/145; 407/118, 119

[56] References Cited

U.S. PATENT DOCUMENTS

| | | | |
|---|---|---|---|
| 2,511,991 | 2/1948 | Nussbaum | 175/410 |
| 4,128,136 | 12/1978 | Generoux | 175/410 |
| 4,156,329 | 5/1979 | Daniels et al. | 175/329 |
| 4,255,165 | 3/1981 | Dennis et al. | 51/309 |

*Primary Examiner*—James A. Leppink

*Assistant Examiner*—Matthew Smith

*Attorney, Agent, or Firm*—Burns, Doane, Swecker & Mathis

[57] ABSTRACT

A cutting blank, preferably for use on a drill bit for cutting through earth formations, comprises a substrate formed of a hard material and including a cutting surface. A plurality of shallow grooves are formed in the cutting surface and each groove includes opposing side and base portions. Strips of a diamond substance are disposed in the grooves and are adhered to the side and base portions and include a cutting face exposed adjacent to the cutting surface of the substrate. The strips may be arranged in various patterns and may be in non-intersecting relationship, or intersecting relationship. The grooves may include undercut portions to more positively anchor the strips to the substrate. The cutting blank is preferably bonded to a stud, with the stud being mounted in a rotary drill bit.

20 Claims, 10 Drawing Figures

Fig. 1
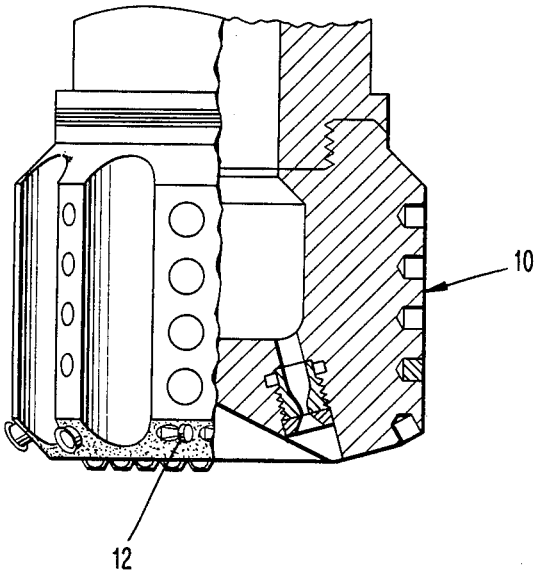
Fig. 2
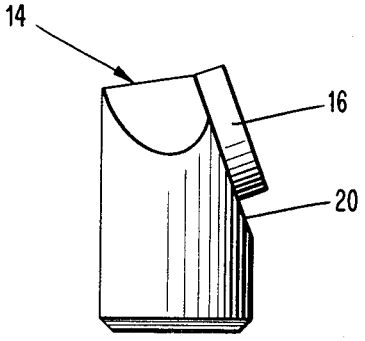
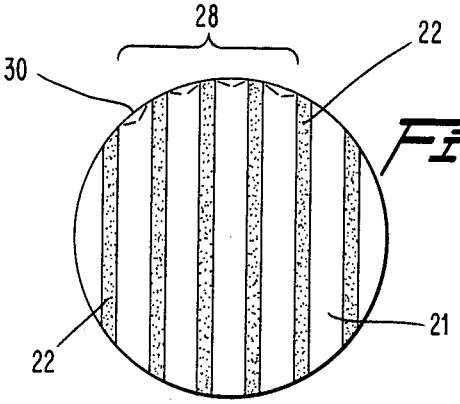
Fig. 3
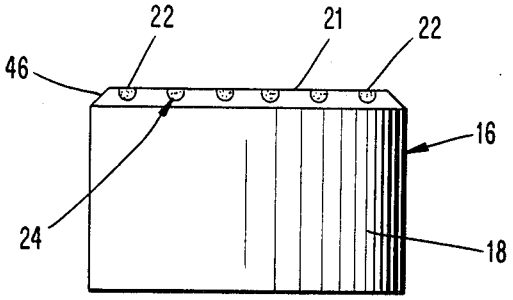
Fig. 4
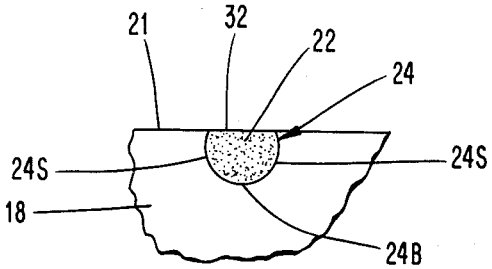
Fig. 5

CUTTING BLANK WITH DIAMOND STRIPS IN GROOVES

BACKGROUND AND OBJECTS OF THE INVENTION

The present invention relates to cutting elements of the type which are mounted on rotary drill bits for cutting through earth formations (including rock formations), cement, plugs, etc.

Rotary drilling operations in earth formations are typically carried out using a rotary drill bit which is simultaneously rotated and advanced into the formation. Cutting is performed by cutting elements mounted on the drill bit, and the cuttings are flushed to the top of the borehole by the circulation of drilling fluid.

A conventional cutting element may comprise a cutting blank mounted on a cemented carbide stud. The blank may include a diamond disk disposed on a carbide substrate. The blank can be braze bonded to an inclined face of the stud, and the stud 18 is then secured, e.g., by press-fit, in a recess of the drill bit. Cutting elements of this type are disclosed, for example, in Rowley et al U.S. Pat. No. 4,073,354; Rohde et al U.S. Pat. No. 4,098,363; and Daniels et al U.S. Pat. No. 4,156,329. During the use of cutting elements of this type, cutting takes place by means of a section of the peripheral edge of the blank which is brought into contact with the formation being cut. While being effective in relatively soft formations, such a cutter is much less effective in hard formations (e.g., rock), due to the relatively large portion of the diamond layer which contacts the formation. Also, a large cutting portion results in the occurrence of considerable friction-generated heat which accelerates the deterioration of the cutting element.

Cutter element configurations have been proposed in Dennis et al U.S. Pat. No. 4,255,165 issued Mar. 10, 1981 in which a claw-like cutting action is to be achieved by "fingers" of diamond material formed by means of a technique which involves the sandwiching of a diamond mix between carbon layers and the application of high temperature and high pressure. However, serious problems were encountered when attempts were made to reduce such cutters to practice. Possibly, a major contributing factor to those problems related to the sandwiching of the diamond layer between the carbide layers whereby the "cobalt sweep" from the cemented carbide through the diamond (resulting from the melting of the cobalt by the high temperatures) occurred in such manner that impurities were swept to, and accumulated at, an internal region of the diamond layer along with excess cobalt. Impurities and excess cobalt which accumulate in that manner tend to cause the diamond layer to separate and create a weakened, poorly sintered zone which is particularly susceptible to cracking during a cutting operation. It would be desirable, then, to provide a cutting element which exhibits a claw-like cutting action and yet which is durable and firmly reinforced.

It would also be desirable to provide a cutting element wherein the diamond layer is more securely adhered to a substrate than in conventional cases wherein a diamond disk is adhered to a substrate.

It is, therefore, an object of the present invention to provide a cutting element which exhibits a claw-like or finger-like cutting action and yet which is highly durable and firmly reinforced.

A further object is to provide such a cutting element which can be produced under high or low temperature conditions.

An additional object is to produce a cutting element wherein, when produced under high temperature conditions, the resulting "cobalt sweep" causes at least most impurities and excess cobalt to be swept out of the interior of the diamond layer.

An additional object is to provide such a cutting element with diamond cutting strips which are firmly reinforced along three sides.

A further object is to provide such a cutting element which minimizes the amount of friction generated during use.

One further object is to provide such a cutting element which minimizes cost by significantly reducing the amount of diamond in the cutting element.

SUMMARY OF PREFERRED EMBODIMENTS OF THE INVENTION

The present invention relates to a cutting blank, preferably for use in cutting through earth formations. The cutting blank comprises a substrate formed of a hard material, such as cemented carbide, and including a cutting surface. A plurality of shallow grooves are formed in the cutting surface and each groove includes opposing side and base portions. Strips of a diamond substance are disposed in respective ones of the grooves and are adhered to the side and the base portions thereof. Each strip includes a cutting face exposed at the cutting surface of the substrate.

The strips may extend toward a peripheral edge of the substrate and may terminate short of such edge or extend all the way thereto. The strips may be non-intersecting, or could be interconnected, such as at their ends to form an ungulating pattern, or chevrons for example. An outer curvalinear strip may interconnect outer ends of other strips to form an extended cutting edge for use in softer formations. The strips may comprise two sets of strips, with each set extending toward a different section of the peripheral edge; the strips of one set may be spaced from the strips of the other set by a central region of the cutting surface.

The diamond substance may comprise either a thermally stable polycrystalline diamond or a thermally unstable polycrystalline diamond. The diamond substance can be sintered in place in the grooves, or brazed within the grooves, for example.

The grooves may have a depth in the range from 0.080 to 0.135 inches and a width in the range of from 0.02 to 0.16 inches. The grooves may include under cut portions to promote stability of the diamond strips.

The cutting blank is preferably bonded to a stud, such as a cemented tungsten carbide stud, and the stud is preferably press-fit into a drill bit.

THE DRAWINGS

The objects and advantages of the invention will become apparent from the following detailed description of preferred embodiments thereof in connection with the accompanying drawings, in which like numerals designate like elements, and in which:

FIG. 1 is a side elevational view, partly in longitudinal section, depicting cutting elements according to the present invention;

FIG. 2 is a side elevational view of a cutting element according to the present invention;

FIG. 3 is a top plan view of one form of cutting blank according to the present invention;

FIG. 4 is a side elevational view of the blank depicted in FIG. 3, and additionally depicting a beveling of the peripheral edge of the blank;

FIG. 5 is an enlarged fragmentary side elevational view of the cutting blank of FIG. 3 depicting an end of a diamond strip;

DETAILED DESCRIPTION OF PREFERRED EMBODIMENTS OF THE INVENTION

Figure 6:
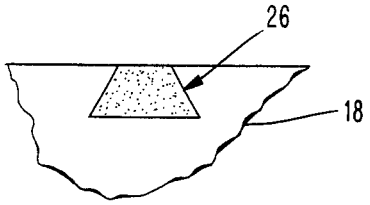
FIG. 6 is a strip similar to FIG. 5 depicting a differently shaped diamond strip.

Depicted in FIG. 1 is a drill bit 10 in which cutting elements 12 according to the present invention are mounted in conventional fashion, e.g., by a press-fit.

The cutting element comprises a stud 14 formed of a hard material such as cemented tungsten carbide. The stud has an inclined face 15 to which a circular cylindrical cutting blank 16 is mounted. The cutting blank 16 comprises a substrate 18 formed of a hard material such as cemented tungsten carbide, the underside of which is brazed to the face 15 of the stud in a conventional manner.

Mounted on the top surface 21 of the substrate 18 is a diamond cutting arrangement in the form of narrow, thin strips 22 of a diamond substance situated in narrow, shallow grooves 24. The diamond substance is preferably in the form of a thermally unstable polycrystalline type which is sintered or brazed within the grooves by well known techniques, or a thermally stable polycrystalline diamond secured in the grooves by conventional brazing or quick-press techniques. As a matter of interest, attention is directed to U.S. Pat. No. 3,745,623 for a discussion of methods for adhering a diamond layer to a carbide substrate, the disclosure of which is incorporated herein by reference.

The grooves 24 are preferably formed by being cut directly into the top surface 21 of the substrate. Alternatively, the grooves could be formed-in-place during the fabrication of the substrate. The width and depth of the grooves may vary, although it is preferable that the depth be in the range of from 0.080 to 0.135 inches (2 to 3.375 mm), and that the width be in the range of from 0.02 to 0.16 inches (0.5 to 4.0 mm).

The grooves 24 each surround a substantial portion of the strip 22, as viewed in cross-section, while leaving an outer cutting face 32 of the strip exposed adjacent the top cutting surface 21 of the substrate 18. In FIG. 5, the groove 24 is shown as including opposing side portions 24S and a base portion 24B, whereby the groove surrounds three sides of the strip, leaving the remaining side 32 exposed.

The grooves 24 can assume any suitable shape in cross-section. For example, the grooves can be undercut, e.g., a dove-tail undercut 26 is depicted in FIG. 6, in order to enhance the securement of the diamond strip within the groove.

During a cutting operation, a section 28 of the peripheral edge 30 of the blank 16 is subjected to a cutting action, whereupon the carbide material in that section quickly wears away (along the broken lines in FIG. 3), exposing the tips or outer edges of the diamond strips 22 which cut through the formation in a rake or claw-like manner. Such a cutting action is especially effective in hard formations because the cutting forces can be concentrated at the diamond strips; the portions of the formation situated between the strips will fracture as the strips rake through the formation. Cutting efficiency is high in that case because the energy necessary for the diamond strips to remove chips from the formation is relatively low.

The formation of the diamond strips 22 can be achieved by any presently known technique, thereby facilitating fabrication of the cutting elements. Furthermore, the diamond strips are highly durable, even when formed-in-place by a high temperature process, such as sintering, because no highly weakened internal zones are present. That is, it has been found that during a sintering process the "cobalt sweep" occurs in such fashion in the present invention that at least most impurities and excess cobalt are swept toward the open or exposed face 32 of the strip and out of the interior of the diamond layer. That is, as molten cobalt flows through the diamond layer from the surrounding portions 24S, 24B of the groove, the cobalt is, in effect, biased generally toward the open face 32 to remove impurities and excess cobalt from the interior of the diamond layer. Residual impurities and/or excess cobalt remaining on the exposed face 32 of the diamond strip can be easily machined-off, or worn-off during a cutting operation. Such sweeping-out of impurities and excess cobalt is substantially more efficient and effective than in cases where a diamond layer is subjected to a cobalt flow from only two opposing directions, even when both of the remaining two sides are exposed. In the latter case, considerable amounts of impurities and/or excess cobalt can accumulate internally of the diamond layer.

The securement of the diamond strips 22 in the grooves is achieved without creating problematic internal stress in the diamond. That is, in the bonding together of layers of different materials (e.g., diamond and carbide) certain diverse characteristics of the materials (such as thermal expansion coefficient and elastic modulus, for example) can lead to the creation of internal stress (stored energy) between the layers, which stress may tend to eventually break the bond between the layers. In the present invention, since only narrow, thin strips of diamond are employed, the total contact surface area between the diamond and carbide materials is relatively small, as compared for example with the larger conventional disc-shaped diamond layer. Hence, the potential for loss of the diamond material is reduced. Furthermore, the diamond is supported on three sides, i.e., along the groove side and base portions, whereby maximum reinforcement of the diamond is afforded as cutting proceeds.

Figure 7:
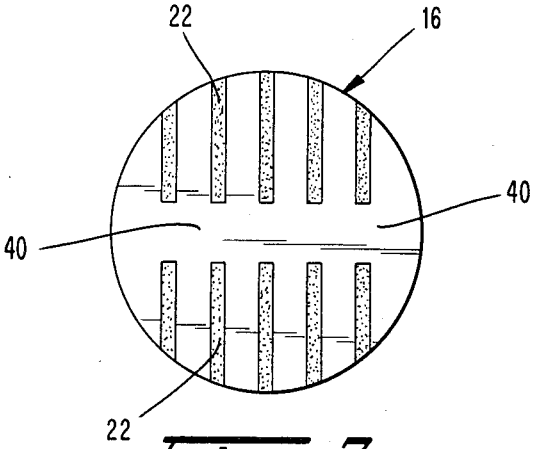
FIGS. 7, 8, 9, and 10 are top plan views of four modified forms, respectively, of the cutting disk according to the present invention.

During cutting, when the diamond strips 22 have become sufficiently worn, the cutter blank can be indexed by breaking the bond between the substrate 18 and the stud 14, and rotating the blank 180 degrees. When re-brazed, the blank 18 will present to the formation a fresh cutting edge section and fresh diamond strip ends. If such a practice is followed, the diamond strips could be interrupted at their midpoints 40, as depicted in FIG. 7 since the cutting blank would normally be indexed before the diamond strips were worn to that extent.

It is not necessary for the diamond strips 22 to initially extend all the way to the peripheral edge of the blank 16, since the carbide will wear rapidly in hard formations to bring the diamond strips quickly into play. If desired, the peripheral edge of the blank 16 can be beveled as shown at 46 in FIG. 4.

Figure 9:
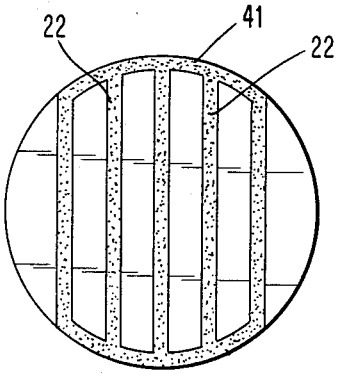
Figure 8:
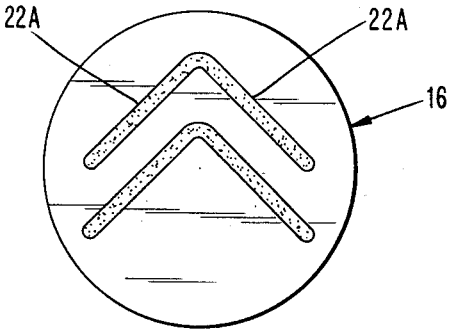

The diamond strips can assume various sizes, orientations and shapes within the scope of the present invention. For example, in FIG. 8 the strips 22A are interconnected to define a chevron. Also, the strips need not be linear when viewed in the direction of FIG. 3, but rather could be curvalinear. Moreover, the ends of the strips 22 could be interconnected by a curved strip 41 as depicted in FIG. 9, whereby the curved strip 41 forms a relatively large cutting edge which is suited to cutting in soft formations, but which would wear away in hard formations to expose the remaining strips 22.

Figure 10:
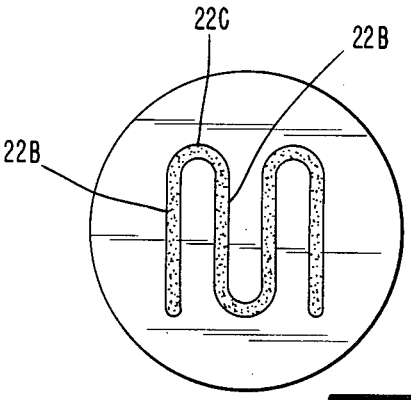

As depicted in FIG. 10, a plurality of strips 22B can be provided which are interconnected at their ends by curvalinear strips 22C to form an undulating pattern.

In accordance with the present invention, the overall amount of diamond substance employed in the blank 16 is relatively small, especially as compared with standard cutting elements in which diamond disks are employed. As a result, the cutting elements can be fabricated more economically.

A cutting blank formed in accordance with the present invention provides a finger-like cutting action by means of highly durable diamond strips. The diamond strips can be formed by any suitable technique and may comprise thermally stable or unstable polycrystalline diamond, as desired. Even when sintered-in-place, the diamond is durable because impurities and excess cobalt are swept out of the interior of the diamond strip. The strips are supported on three sides for maximum reinforcement. During a cutting action, minimum friction is generated and minimum energy is required because the fingers produce relatively large chips and the remaining portions of the formation fracture as the finger(s) rakes through the formation.

Although the present invention has been described in connection with preferred embodiments thereof, it will be appreciated by those skilled in the art that modifications, additions, deletions, and substitutions may be made without departing from the spirit and scope of the invention as defined in the appended claims.

What is claimed is:

1. A cutting blank comprising:

a substrate formed of cemented carbide and including a cutting surface, a plurality of shallow grooves formed in said cutting surface and each including opposing side and base portions formed of said cemented carbide, and strips of a diamond substance disposed in respective ones of said grooves and adhered to said side and base portions and extending to said cutting surface of said substrate to define an exposed cutting face lying substantially flush with said cutting face.

2. A cutting blank according to claim 1, wherein said strips extend toward a peripheral edge of said substrate.

3. A cutting blank according to claim 2, wherein said strips extend all the way to said peripheral edge.

4. A cutting blank according to claim 1, wherein said strips are interconnected.

5. A cutting blank according to claim 4, wherein said strips are interconnected at their outermost ends.

6. A cutting blank according to claim 1, wherein at least one of said strips is curvalinear.

7. A cutting blank according to claim 1, wherein said strips include two sets of strips, each set extending toward a different section of said peripheral edge, the strips of one set being spaced from the strips of the other set by a central region of said cutting surface.

8. A cutting blank according to claim 1, wherein said strips are interconnected to form a chevron.

9. A cutting blank according to claim 1, wherein said strips form an undulating pattern.

10. A cutting blank according to claim 1, wherein said diamond substance comprises a thermally stable polycrystalline diamond.

11. A cutting blank according to claim 1, wherein said diamond substance comprises a thermally unstable polycrystalline diamond.

12. A cutting blank according to claim 1, wherein said grooves include undercut portions.

13. A cutting blank according to claim 1, wherein said grooves have a depth in the range of from 0.080 to 0.135 inches.

14. A cutting blank according to claim 13, wherein said grooves have a width in the range of from 0.02 to 0.16 inches.

15. A cutting blank according to claim 1, wherein said substrate is of one-piece integral construction.

16. A cutting blank according to claim 1, wherein said substrate is formed of a cemented carbide.

17. A cutting blank according to claim 1, wherein said diamond substance is sintered-in-place in said grooves.

18. A cutting blank according to claim 1, wherein said diamond substance is brazed in said grooves.

19. A cutting element for cutting through earth formations, comprising:

a stud having an outer end surface, and a cutting blank mounted on said outer end surface and including:

a substrate formed of cemented carbide and including a mounting surface bonded to said outer end surface, and a cutting surface disposed opposite said mounting surface, a plurality of shallow grooves formed in said cutting surface and each including opposing side and base portions, and strips of a diamond substance disposed in respective ones of said grooves and adhered to said side and base portions and extending to said cutting surface of said substrate to define an exposed cutting face lying substantially flush with said cutting surface.

20. A drill bit comprising:

a bit body having a cutting face, a plurality of cutting elements mounted in said cutting face and comprising:

a stud having an outer surface, and a cutting blank mounted on said outer surface and including a substrate formed of a hard material and including a cutting surface, a plurality of shallow grooves formed in said cutting surface and each including opposing side and base portions, and strips of a diamond substance disposed in respective ones of said grooves and adhered to said side and base portions and extending to said cutting surface of said substrate to define an exposed cutting face lying substantially flush with said cutting surface.

* * * * *